US007210672B2

(12) United States Patent
Ishii

(10) Patent No.: US 7,210,672 B2
(45) Date of Patent: May 1, 2007

(54) ACCELERATOR APPARATUS FOR DIAPHRAGM CARBURETORS

(75) Inventor: Takashi Ishii, Iwate-ken (JP)

(73) Assignee: ZAMA Japan Co., Ltd., Iwate-Gun, Iwate-ken (JP)

( * ) Notice: Subject to any disclaimer, the term of this patent is extended or adjusted under 35 U.S.C. 154(b) by 0 days.

(21) Appl. No.: 11/218,429

(22) Filed: Sep. 6, 2005

(65) Prior Publication Data

US 2007/0052116 A1 Mar. 8, 2007

(51) Int. Cl.
*F02M 7/08* (2006.01)

(52) U.S. Cl. ..... 261/34.2; 123/437; 261/35

(58) Field of Classification Search ..... 261/34.2, 261/35; 123/437, 344
See application file for complete search history.

(56) References Cited

U.S. PATENT DOCUMENTS 2,551,719 A * 5/1951 Ball ..... 261/34.2
3,017,167 A * 1/1962 Griffen ..... 261/34.2
4,076,770 A * 2/1978 Saito et al. ..... 261/34.2
5,843,345 A * 12/1998 Guntly ..... 261/34.2
6,293,524 B1 * 9/2001 Endo et al. ..... 261/34.2
6,595,500 B2 * 7/2003 Osburg et al. ..... 261/34.2
6,676,114 B2 * 1/2004 Gerhardy ..... 261/34.2
6,938,884 B2 * 9/2005 Knaus et al. ..... 261/34.2
2002/0163087 A1 * 11/2002 Gerhardy ..... 261/34.2

FOREIGN PATENT DOCUMENTS

JP 52-43026 * 4/1977 ..... 261/34.2

* cited by examiner

*Primary Examiner*—Richard L. Chiesa
(74) *Attorney, Agent, or Firm*—Baker Botts L.L.P.

(57) ABSTRACT

An accelerated fuel passage of an accelerator pump operatively connected with a throttle shaft having a throttle valve. The accelerated fuel passage is connected to an upstream side of a needle orifice, which orifice is coupled to a main nozzle. Consequently, the fuel is discharged by the accelerator pump into an area before the needle orifice. By the addition of a one-way check valve system in a fuel pick up at a metering chamber for a fuel circuit, the fuel driven by the accelerator pump piston is discharged to a venturi tube of an intake passage through the main nozzle. A self pumping effect caused by an engine pulsation is dampened or eliminated by the needle orifice. Further, a check valve is provided within a fuel pick up at a metering chamber for a fuel circuit, whereby the fuel driven by the accelerator pump piston is discharged to a venturi tube through a main nozzle without returning to the fixed fuel chamber.

7 Claims, 2 Drawing Sheets

ACCELERATOR APPARATUS FOR DIAPHRAGM CARBURETORS

BACKGROUND OF THE INVENTION

1. Field of the Invention

The present invention relates to accelerator apparatus provided in diaphragm carburetors supplying fuel to general purpose engines having limited displacement.

2. Description of Related Art

Many carburetors for supplying fuel to general purpose engines, particularly, general purpose engines having limited displacements, employ a diaphragm provided within a fixed fuel chamber regulating and holding the fuel supplied to an intake passage. The diaphragm maintains the fuel at a substantially constant pressure.

In such diaphragm carburetors, it is a known technology to supply an accelerated fuel to the intake passage in correspondence with an amount of intake air. The fuel acceleration is increased at a time when an opening degree of a throttle valve is increased for the purpose of increasing a rotational speed of an engine when a rapid acceleration is performed or when a load is applied. The diaphragm carburetor is provided with an accelerator apparatus using a piston-type or diaphragm-type accelerator pump, which operates mechanically with a throttle shaft having a throttle valve.

Further, in a known accelerator apparatus, as depicted in FIG. 2, an accelerated fuel passage draws the fuel to an accelerator pump activated by a cam 17 on a throttle shaft (not shown) having a throttle valve 2. Thus, an accelerated fuel flow is delivered directly to a main nozzle 9 open to a venturi tube 25 of an intake passage 3 from a fixed fuel chamber. Nevertheless, this accelerator apparatus is structured, such that the fuel is driven to venturi tube 25 through main nozzle 9.

Accordingly, when the engine is running in the full open throttle condition, the pulsation created by the engine affects to main nozzle 9. The pulsation may deliver an additional volume of fuel to the accelerator pump circuit through main nozzle 9. The pulsation effect may cause an unstable emission value, and in an undesirable case, the engine may not run properly because of this known "self pumping effect" when there is air or a fuel vapor in the additional volume. The pumping effect may discharge an excess amount of fuel into the engine, and the emission value may increase. In an undesirable case, the engine power declines as well due to the fuel rich condition.

When the engine starts with a dry carburetor condition, the accelerator pump circuit is filled with air, and the air may remain in the accelerator pump circuit until several throttle actions are executed.

Even after removal of the air from the accelerator pump circuit, there is a risk that the fuel vapor may be generated during the engine operation, due to hot ambient temperatures or a heat transfer from the engine, or both. There also is a risk that the self pumping effect may be generated by the engine vibration. Further, unstable emissions (e.g., unstable air-to-fuel ratio) are a problem for engine manufacturers due to an emission regulations.

SUMMARY OF THE INVENTION

A need has arisen for an accelerator apparatus which avoids problems with exhaust gas, by obtaining a more stable engine operation when a throttle is fully open in a diaphragm carburetor and by obtaining an extremely preferable air-to-fuel ratio.

In accordance with the present invention, an accelerated fuel passage of an accelerator pump operatively connected with a throttle shaft comprising a throttle valve is connected to an upstream side of a needle orifice (e.g., a higher speed needle orifice) coupled to a main nozzle, whereby the fuel is discharged by the accelerator pump into an area before the needle orifice. By an additional one-way check valve system in a fuel pick up at a metering chamber for a fuel circuit, the fuel driven by the accelerator pump piston is discharged to the venturi tube through the main nozzle.

Accordingly, because the fuel is discharged to the upstream side of the needle orifice, in which orifice the amount of the fuel supplied by the main nozzle and required by the engine is adjusted, the self pumping effect caused by the engine pulsation at the full open throttle position is dampened or eliminated by the orifice as it is the most restricted point in the fuel circuit. Therefore, the problem of the unstable emission and running condition will be solved by the design.

Further, in accordance with the present invention, a check valve which may be opened in a direction of the needle orifice is provided in the main fuel passage and connecting the fixed fuel chamber and the needle orifice. Thus, a back flow of the accelerator pump fuel into the fixed fuel chamber may be reduced or prevented. Because all the fuel is discharged to the engine, acceleration performance may be maintained or improved.

Further objects, features, and advantages of the present invention will be understood from the following detailed description of preferred embodiments of the present invention with reference to the accompanying figures.

BRIEF DESCRIPTION OF THE DRAWINGS

Embodiments of the invention now are described with reference to the accompanying figures, which are given by way of example only, and are not intended to limit the present invention.

DESCRIPTION OF PREFERRED EMBODIMENTS

Figure 1:
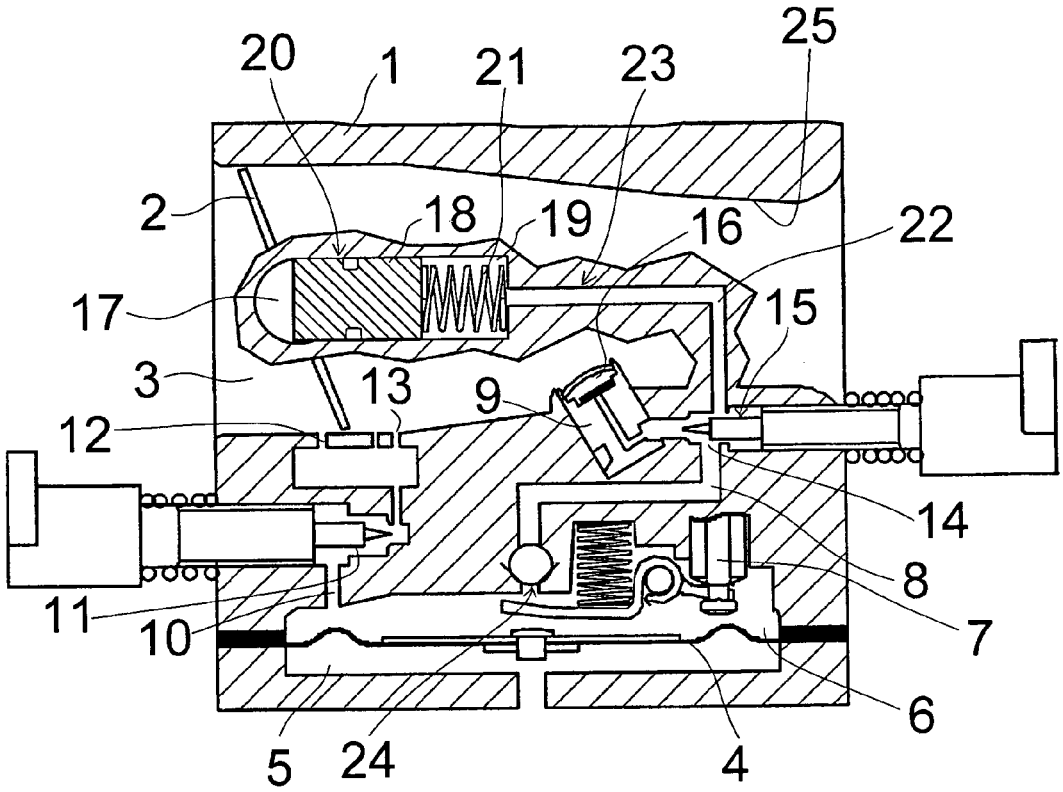
FIG. 1 is a cross-sectional view of an embodiment of a carburetor, in accordance with the present invention.
Figure 2:
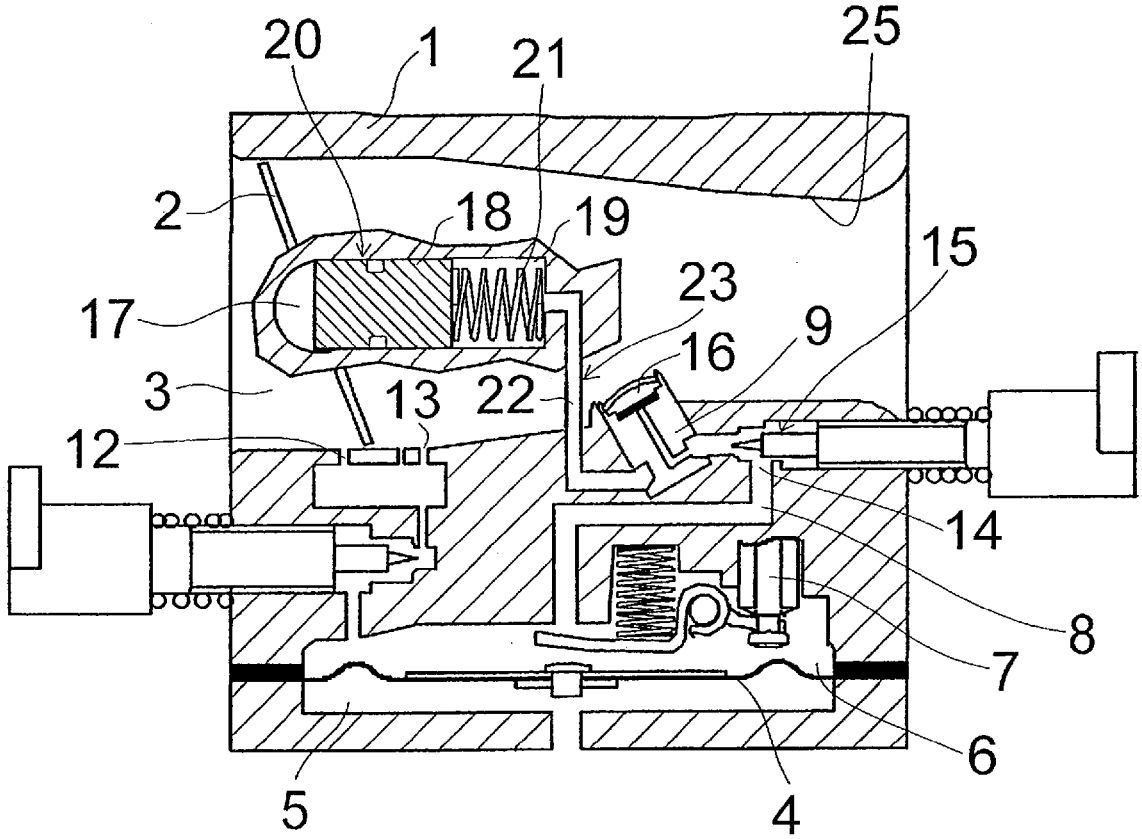
FIG. 2 PRIOR ART
FIG. 2 is a cross-sectional view of a known embodiment of a carburetor.

FIG. 1 depicts a preferred embodiment of a carburetor in accordance with the present invention. A carburetor main body 1 comprises an axial intake passage 3 comprising a throttle valve 2, and a fixed fuel chamber 6 separated from an atmospheric air chamber 5 by a diaphragm 4 in a lower portion of chamber 6. Fuel from a fuel tank (not shown) is delivered to fixed fuel chamber 6 through a needle valve 7 actuated so as to open and close in correspondence with a displacement of diaphragm 4 by a priming pump or a fuel pump.

The fuel flow is regulated at a desired flow rate by a needle valve component (not shown) of needle valve 7 so as to be delivered to a main nozzle 9 open to a venturi tube 25 through a higher speed fuel passage 8. The fuel flow also is regulated at a flow rate through a lower speed fuel passage 10 by a fuel regulating needle valve component 11 so as to be delivered to the vicinity of throttle valve 2 in intake passage 3 from an idle port 12 and a slow port 13. Further, main fuel passage 8 has a manual, regulating needle valve component 15 regulating a fuel flow rate by a higher speed needle orifice 14 defining a maximum fuel flow rate. Main nozzle 9 comprises a check valve 16 for preventing air in intake passage 3 from entering into fixed fuel chamber 6.

Further, in accordance with the present embodiment, an accelerator pump 20 comprises a piston 18 fitted to a cylinder by a cam 17 operatively connected to a throttle shaft (not shown) of throttle valve 2 which always oscillates cam 17 with the valve shaft by a push spring 21. An accelerator pump chamber 19 of accelerator pump 20 is operatively connected to an upstream side of higher speed needle orifice 14, which includes regulating needle valve component 15 in an accelerated fuel passage 22. Accelerator pump 20 and the accelerated fuel passage form an accelerator apparatus 23.

In addition, in accordance with the present embodiment, a check valve 24 which is open only on the side of higher speed needle orifice 14 is installed in a higher speed fuel passage 8. Passage 8 places fixed fuel chamber 6 in communication with the regulating needle valve component 15 of higher speed needle orifice 14.

Further, when throttle valve 2 is in an idle position, pump chamber 19 is increased to a maximum capacity by cam 17, and when throttle valve 2 is opened, the fuel in pump chamber 19 is delivered to higher speed needle orifice 14 via accelerated fuel passage 22 by pressing piston 18 against an energizing force of push spring 21 by cam 17. Accordingly, in fixed fuel chamber 6, a negative pressure is reduced and becomes a positive pressure, and a pressure difference between the negative pressure generated in a region of throttle valve 2 of intake passage 3 and venturi tube 25 is increased, so that the amount of fuel delivered from main nozzle 9 is increased, and the increased fuel amount is supplied as an accelerated fuel flow to the engine (not shown).

In particular, in the present embodiment, because accelerator apparatus 23 is connected to the upstream side of higher speed needle orifice 14 comprising the regulating needle valve component 15, the fuel is discharged to the upstream of higher speed needle orifice 14 having the regulating needle valve component 15, in which the amount of the fuel required by the engine at the full open throttle position is adjusted, so that the self pumping effect caused by the engine pulsation is dampened or eliminated by orifice 14 as it is the most restricted point in the fuel circuit. Therefore, the problem of the unstable emission and running condition may be reduced or eliminated by this configuration.

Further, check valve 24 disposed in higher speed fuel passage 8 prevents the back flow of fuel in accelerator pump 20 into the metering chamber. Because all the fuel is discharged to the engine, acceleration performance may be maintained or improved.

Other embodiments of the invention will be apparent to the skilled in the art from consideration of this specification or practice of the invention disclosed herein. It is intended that the specification be considered as exemplary only. Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. An accelerator apparatus of a diaphragm carburetor, comprising an accelerator pump comprising an accelerated fuel passage operatively connected with a throttle shaft comprising a throttle valve, which accelerated fuel passage is connected to an upstream side of a needle orifice, which orifice is also connected to a higher speed fuel passage and arranged in a restricted point of a fuel passage extending from a fixed fuel chamber to a main nozzle, said fuel passage comprising said accelerated fuel passage and said higher speed fuel passage.

2. The accelerator apparatus as claimed in claim 1, wherein a check valve is disposed in a main fuel passage connecting the fixed fuel chamber and the needle orifice and is adapted to open to the needle orifice.

3. An accelerator apparatus of a diaphragm carburetor, comprising:

a needle orifice comprising a first connection to an accelerated fuel passage, a second connection to a higher speed fuel passage, and a third connection to a main nozzle;

an accelerator pump connected to said accelerated fuel passage; and a fixed fuel chamber connected to said higher speed fuel passage, wherein said needle orifice is provided at a restricted point of a fuel passage, said fuel passage comprising said accelerated fuel passage and said higher speed fuel passage.

4. The accelerator apparatus of claim 3, further comprising a check valve disposed in said higher speed fuel passage, said check valve preventing a back flow of fuel into said fixed fuel chamber.

5. The accelerator apparatus of claim 3, further comprising a throttle shaft and a throttle valve operatively connected to said accelerator pump.

6. The accelerator apparatus of claim 3, wherein said first connection is provided at an upstream side of said needle orifice.

7. The accelerator apparatus of claim 6, wherein said needle orifice consists of said first connection, said second connection, said third connection, and a needle valve component.

* * * * *